United States Patent [19]

Aoki et al.

[11] Patent Number: 4,871,639

[45] Date of Patent: Oct. 3, 1989

[54] CARRIER FOR ELECTROPHOTOGRAPHIC DEVELOPER

[75] Inventors: Takayoshi Aoki; Ikutaroh Nagatsuka; Masayuki Takeda, all of Kanagawa; Toshio Honjo, Chiba; Kazuhiro Itoh, Chiba; Kenji Uchida, Chiba, all of Japan

[73] Assignees: Fuji Xerox Co., Ltd.; Nippon Iron Powder Co., Ltd., both of Japan

[21] Appl. No.: 63,053

[22] Filed: Jun. 17, 1987

[30] Foreign Application Priority Data

Jun. 17, 1986 [JP] Japan ..... 61-139183

[51] Int. Cl.[4] ..... G03G 9/10

[52] U.S. Cl. ..... 430/108; 430/137; 264/5; 264/12; 264/13

[58] Field of Search ..... 430/137, 108; 264/5, 264/12, 13

[56] References Cited

U.S. PATENT DOCUMENTS

| | | | |
|---|---|---|---|
| 3,520,811 | 7/1970 | Swoboda et al. | 430/106.6 X |
| 4,076,640 | 2/1978 | Forgensi et al. | 430/108 X |
| 4,265,992 | 5/1981 | Kouchi | 430/137 X |
| 4,345,014 | 8/1982 | Oka et al. | 430/106.6 X |

*Primary Examiner*—J. David Welsh

*Attorney, Agent, or Firm*—Sughrue, Mion, Zinn, Macpeak, and Seas

[57] ABSTRACT

A carrier for developer is disclosed, which is produced by a process including the steps of mixing and heating a carrier material containing a binder resin and a magnetic powder and essentially free of solvent to obtain a molten dispersion of the magnetic powder in the resin; spraying the molten dispersion into droplets; and cooling the droplets to solidify the droplets into carrier particles. The carrier has excellent sphericality, high surface smoothness, and long life when used as a component of a two-component type developer in electrophotography.

10 Claims, No Drawings

CARRIER FOR ELECTROPHOTOGRAPHIC DEVELOPER

FIELD OF THE INVENTION

The present invention relates to a carrier useful as one component of a two-component type developer for use in development of electrostatic latent images or magnetic latent images in such techniques as the electrophotographic method, the electrostatic recording method and the electrostatic printing method. More particularly, it relates to an improved spherical carrier having magnetic particles dispersed therein.

BACKGROUND OF THE INVENTION

In the electrophotographic method, an electric latent image is generally formed by various techniques using a photoconductive substance, e.g., selenium, as a photoreceptor and the latent image is developed by attaching tones thereto, utilizing techniques such as the magnetic brush developing method.

In this developing step, a two-component type developer is most commonly used in which carrier particles called "carriers" are used in combination with the toner to provide a suitable amount of positive or negative electric charge. Various types of carriers have been developed and put into practical use.

The carrier is required to have various characteristics. Particularly important among these characteristics are charging properties, impact resistance, abrasion resistance, developing properties, developer life, environmental independency in charge properties, and stability of charge properties with passage of time.

In view of the above characteristics, conventional carriers still remain inadequate; in fact, no sufficiently satisfactory carrier has yet been produced. For example, electrically conductive carriers, e.g., iron oxide powder, have the disadvantages that fine line reproducibility is poor, although solid developability is excellent, and further that it is necessary for a special charge controlling agent to be added to the toner in order to prolong the service life of the developer. Coated insulating carriers have the disadvantage that solid reproducibility is poor, although service life and reproducibility of fine lines are excellent. In order to overcome the above problems, small particle diameter carriers for magnetic brush development, containing a binder resin and fine magnetic particles dispersed therein, i.e., "microtoning carriers", have been proposed and put into practical use, as disclosed, for example, in U.S. Pat. No. 4,345,014 and Japanese Patent Application (OPI) No. 66134/79. (The term "OPI" as used herein refers to an "unexamined published Japanese patent application."

Such fine magnetic particle-containing carriers previously have been produced either by (1) the melt kneading pulverization method or (2) the solution spray cooling method. . Using the first method, a mixture of a resin and a powdered magnetic substance is melt kneaded and solidified, and then pulverized, after which the resulting powder is sieved to obtain carriers having the desired particle diameter. This method, however, has the disadvantage of low efficiency in producing carriers having the desired particle diameter. Furthermore, it is difficult to produce spherical carriers by this method. The carriers have irregular surfaces, and when they are used, the magnetic powder is freed by friction or contact.

In the second method, a powdered magnetic substance is dispersed in a solution of a resin in a solvent, and the resulting dispersion is sprayed while maintaining the temperature in a range at which the solvent evaporates (e.g., up to about 150° C.), to produce the desired carriers. The surface of the carrier produced by this method is porous and brittle because solidification proceeds with evaporation of the solvent, making it impossible to apply a subsequent coating treatment.

As described above, conventional microtoning carriers have disadvantages such as adhesion of carriers to a photoreceptor due to their small diameter in size, changes in charging properties under high and low humidity conditions, caused by magnetic particles freed from their surface, and the further problem that since it is difficult to apply a surface treatment, it is impossible to dramatically prolong service life by coating.

SUMMARY OF THE INVENTION

An object of the present invention is to provide a carrier for a developer without the problems of conventional fine magnetic particle-containing carriers, which is spherical and hard and has excellent surface smoothness.

Another object of the present invention is to provide a carrier for magnetic brush development having good surface soiling resistance, causing no reduction in the amount of charge, free from problems such as formation of fog at an early stage and contamination of the inside of a copying machine, and further which is excellent in high speed developing properties and in extending the service life of the developer.

It has now been found that these and other objects can be attained by a carrier produced by a process including the steps of (A) mixing and heating a carrier material containing a binder resin and a magnetic powder and essentially free of solvent to obtain a molten dispersion of the magnetic powder in the binder resin; (B) spraying the molten dispersion into droplets; and (C) cooling the droplets to solidify the droplets into carrier particles.

The carrier of the present invention is spherical and high in surface smoothness, as a result of the particular process used for its production, that involves spraying the molten material without the use of an added solvent.

DETAILED DESCRIPTION OF THE INVENTION

As the binder resin which is one of the essential components of the carrier of the present invention, any thermoplastic resin can be used. Representative examples include homopolymers and copolymers of styrenes such as styrene, chlorostyrene, and vinylstyrene; monoolefins such as ethylene, propylene, butylene, and isobutylene; vinyl esters such as vinyl acetate, vinyl propionate, and vinyl benzoate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; and vinyl ketones such as vinyl methyl ketone, vinyl hexyl ketone, and vinyl isopropenyl ketone. Typical binder resins that can advantageously be used include polystyrene, a styrene-acrylic acid alkyl ester copolymer, a styrene-methacrylic acid alkyl ester copolymer, a styrene-acrylonitrile copolymer, a styrene-butadiene copolymer, a styrene-maleic anhydride copolymer, and polyolefins such as polyethylene and polypropylene. In addition, polyesters, polyurethanes, epoxy resins, polyamides, modified rosins, paraffins and waxes can be used as a binder.

Preferred among the above binder resins are polyesters, and polyolefins having a weight average molecular weight of from about 500 to 20,000, with polyolefins having a weight average molecular weight of from about 500 to 7,000 being particularly preferred since they make it easy to produce almost completely spherical carriers.

As the fine magnetic particle which is the other essential component of the carrier of the present invention, any conventionally used fine ferromagnetic particles can be used. Representative examples include triiron tetraoxide, γ-diiron trioxide, ferrites, chromium oxide, and metal powders.

The magnetic particle content in the carrier is usually from about 30 to 95 wt % and preferably from about 45 to 90 wt %.

In addition to the binder resin and fine magnetic particles, a charge controlling agent, a dispersion increasing agent, a strength-reinforcing agent, and a coupling agent can be incorporated in the carrier, so long as no substantial amount of solvent is present. The term "solvent" used herein refers to a compound capable of dissolving the binder resin used in the carrier.

The process for producing carriers according to the invention is now explained in greater detail.

The carrier of the present invention can be produced by heating, melting, and mixing the binder resin and fine magnetic particles and, if desired, other components using any conventional apparatuses, including a kneader, a roll mill, a Banbury mixer, a sand mill, and other mixing machines, spraying or air atomizing the kneaded material in a liquid state, and afterward cooling and solidifying it in a gas stream, such as an air stream, maintained at a relatively low temperature. For example, the droplets are cooled by the application of a dry air stream downward or upward thereto.

In more detail, the apparatus for producing the carrier of the present invention comprises a pre-treatment equipment including a heating, melting, and mixing unit and vessel for adjusting the viscosity of the kneaded material, pumps to convey the molten kneaded material to the spraying unit, and cooler to cool and solidify the sprayed kneaded material with a gas stream which is preferably introduced in the cooler in such a manner that an eddy is formed in the cooler, whereby adhesion of the produced carrier particles to the wall of the cooler can be prevented.

As the heating, melting and mixing equipment, any conventional units including a kneader, a roll mill, a Banbury mixer, a sand mill, an attritor, and a Henschel mixer can be used. Of these, a kneader is preferably used, and a pressure or vacuum kneader is particularly preferred for the purpose. As the spraying unit, a nozzle type or disk type unit is suitable for producing carriers having a small particle diameter, although the present invention is not limited thereto.

Factors exerting great influence on the shape and surface properties of the carrier are the viscosity of the kneaded material at the time of spraying, the particle diameter of the magnetic powder, and the cooling temperature. In order to obtain carriers which are spherical and have a relatively high surface smoothness, the viscosity at the time of melting is generally not more than about 10,000 cp, preferably not more than about 7,000 cp at temperatures of about 100° to 200° C.

In connection with the particle diameter of the magnetic powder, the particle diameter is usually not more than about 5 μm and preferably not more than about 2 μm.

The cooling temperature is generally from about 15° to 100° C. and preferably from about 20° to 60° C. At temperatures approaching about 15° C., there is a tendency for insufficiently spherical particles to be produced.

In view of the service life of the developer and the relationship between attachment of carriers to the photoreceptor and image quality, the average particle diameter of the carrier particles of the present invention is preferably from about 20 to 400 μm and more from about 30 to 200 μm. Particles having a particle diameter falling within the above range can be easily obtained by variations of the spraying conditions well-known in the art, such as by controlling the nozzle diameter of the spraying unit or the speed of rotation of the disk.

The carrier of the present invention is a magnetic powder-containing carrier which is highly spherical and has excellent surface smoothness and strength, due to the use of the melt spray cooling method without a solvent.

In connection with the toner, the core of a microcapsule toner has been produced by the melt spray cooling method, as described in Japanese Patent Application (OPI) No. 187349/84. The core of the microcapsule toner is a wax-like substance that is protected with a harder shell substance. Such a core does not require severe physical properties, particularly high strength, and accordingly, the melt cooling method can be easily applied.

On the other hand, the carrier is required to have high durability. Because of the different materials used, it is difficult to set conditions for melting and cooling, such as melt viscosity and cooling temperature. For this reason, the production of carriers by the melt spray cooling method without use of a solvent has not been reported.

The carrier of the present invention produced by the process described above can be used as a magnetic brush developer for development of an electrostatic latent image in admixture with the toner. Since the carrier of the present invention has remarkably improved surface smoothness and is highly spherical, it can be easily subjected to any conventional additional surface treatment or covering treatment, e.g., with a resin, a coupling agent, a surface active agent, a charge controlling agent, or a fine powder.

As the toner that can suitably be used in combination with the carrier of the present invention, any toner commonly used in electrophotographic processes, generally containing a binder resin and a colorant dispersed therein, can be used.

The carrier of the present invention used in a developer is a substantially completely spherical and hard carrier which is produced by uniformly dispersing fine magnetic particles in a binder resin by the specified method. The carrier of the present invention has the advantages that fine line image properties are excellent, strength is increased, deterioration does not occur even when it is used for a long time, and since the separation of the fine magnetic particles from the carrier surface is decreased, environmental stability is enhanced and more particularly, fluctuation of charge density between summer and winter conditions is small. For these reasons, the carrier of the present invention is greatly superior to the magnetic particle dispersion carrier produced by the knead pulverization method. Furthermore, the carrier of the present invention is excellent in surface smoothness, simplifying the coating of various charge controlling agent solutions or dispersions. Accordingly, the carrier of the present invention is stabilized in charging properties and greatly increased in service life.

The present invention is described in greater detail with reference to the following examples, although it is not to be construed as being limited thereto. Unless otherwise indicated, all parts, percents and ratios are by weight.

EXAMPLE 1

Seventy parts of fine magnetic particles (EPT1000 produced by Toda Kogyo Co., Ltd.; composition: magnetic iron oxide; average diameter 0.35 μm) and 30 parts of polyester (a hydrogenated bisphenol A/butanediol/-fumaric acid polycondensate; molar ratio 1/2/3; weight average molecular weight 10,000) were heated at 150° C., melted and kneaded for 20 minutes in a pressure kneader.

After the mixture was sufficiently kneaded, it was adjusted to 6,000 cps in viscosity in a viscosity-adjusting vessel. Then the mixture was cooled and solidified in a disk-type spraying apparatus operating at 10,000 rpm wherein the sprayed molten kneaded material (droplets) was cooled by applying a dry air stream of 25° C. downward to the droplets to eddy, and thereafter sieved to obtain spherical magnetic particle dispersion carriers of the present invention, having an average particle diameter of 55 μm.

The apparent density of the carriers was 1.13 g/cm$^3$ and the saturated magnetization was 59 emu/g.

COMPARATIVE EXAMPLE 1

The same composition as in Example 1 was kneaded by the use of a pressure kneader in the same manner as in Example 1 and then pulverized and sieved by the use of a turbo mill and a siever to obtain amorphous magnetic particle dispersion carriers having an average particle diameter of 50 μm.

EXAMPLE 2

Seventy parts of fine magnetic particles (EPT-1000) and 30 parts of polyethylene (400P produced by Mitsui Petrochemical Co., Ltd.) were heated at 120° C., melted, and kneaded for 20 minutes in a pressure kneader and then sprayed, cooled, and solidified in the same manner as in Example 1. The product was sieved to obtain spherical magnetic particle dispersion carriers of the present invention, having an average particle diameter of 55 μm.

EXAMPLE 3

100 parts of the carriers obtained in Example 2 were coated with a 10% acetone solution of 0.5 part of a styrene-methacrylic acid copolymer (molar ratio 8/20; weight average molecular weight 15,000) by the use of a fluidized bed coating apparatus to obtain spherical magnetic particle dispersion carriers of the present invention.

The carriers obtained in Examples 1 to 3 and Comparative Example 1 were mixed with toners for a Model FX-7770 copying machine (produced by Fuji Xerox Co., Ltd.) in such a manner that the toner concentration was 3% by weight, to thereby obtain the corresponding developers.

These developers were tested for initial image solid density, fog density at the background, reproducibility of fine lines, and tested for the same properties (solid density, fog density at the background, and reproducibility of fine lines) of images after 100,000 sheets were run on a bench machine for evaluation, at a photoreceptor speed of 350 mm/sec and a developing magnetic roll speed of 550 mm/sec, using a Model FX-7770 copying machine. In addition, the amount of charge under conditions of high humidity and low humidity was measured.

The results are shown in the following Table.

TABLE

| | Initial performance | | | | After 1 × 10$^5$ runs | | | | | Environmental test | | |
|---|---|---|---|---|---|---|---|---|---|---|---|---|
| Sample No. | Amount of charge generated (μc/g) | Density of solid image | Fog density at background | Reproducibility of fine lines | Amount of charge generated (μc/g) | Density of solid image | Fog density at background | Reproducibility of fine lines | Life (runs) | Under summer conditions (30° C. 80% RH) | Under winter conditions (10° C. 30% RH) | Total evaluation |
| Example 1 | 20 | 1.35 | 0.00 | A | 14 | 1.40 | 0.02 | A | >1 × 10$^5$ | A | A | A |
| Comp. Example 1 | 18 | 1.39 | 0.00 | A | 9 | 1.33 | 0.08 | B | Ca. 5 ×0 10$^4$ | fogging at[1] background | reduction[2] in density | C |
| Example 2 | 12 | 1.50 | 0.00 | A | 13 | 1.52 | 0.05 | A | >1 × 10$^5$ | A | A | A |
| Example 3 | 22 | 1.28 | 0.00 | A | 18 | 1.35 | 0.01 | A | >1 × 10$^5$ | A | A | A |

A: good
B: fair
C: bad
[1]due to a reduction of the amount of charge generated
[2]due to an increase of the amount of charge generated While the invention has been described in detail and with reference to specific embodiments thereof, it will be apparent to one skilled in the art that various changes and modifications can be made therein without departing from the spirit and scope thereof.

What is claimed is:

1. Carrier particles for providing a triboelectric charge to toner particles by mixing with said toner particles, said carrier particles comprising:

(1) a binder resin consisting essentially of a polyolefin having a weight average molecular weight of from about 500 to 20,000, and (2) a magnetic powder having an average particle diameter of not more than 5μm dispersed in said binder resin, said carrier particles being produced by a process comprising the steps of (A) mixing and heating a carrier material containing said binder resin and said magnetic powder and essentially free of solvent to obtain a molten dispersion of the magnetic powder in the binder resin;

(B) spraying the molten dispersion into droplets; and (C) cooling the droplets to solidify the droplets into carrier particles.

2. A carrier as claimed in claim 1, wherein said binder resin is a polyolefin having a weight average molecular weight of from about 500 to 7,000.

3. A carrier as claimed in claim 1, wherein said carrier contains from about 30 to 95% by weight of said magnetic powder.

4. A carrier as claimed in claim 3, wherein said carrier contains from about 45 to 90% by weight of said magnetic powder.

5. A carrier as claimed in claim 1, wherein said carrier particle has an average diameter of from about 20 to 400 μm.

6. A carrier as claimed in claim 5, wherein said magnetic powder has an average particle diameter of not more than about 2 μm, and said carrier particle has an average diameter of from about 30 to 200 μm.

7. A carrier as claimed in claim 1, wherein the viscosity of said molten dispersion is not more than about 10,000 cp and the temperature of said molten dispersion is from about 100° to 200° C.

8. A carrier as claimed in claim 7, wherein the viscosity of said molten dispersion is not more than about 7,000 cp and the temperature of said molten dispersion is from about 100° to 200° C.

9. A carrier as claimed in claim 7, wherein the cooling temperature in said step (C) is from about 15° to 100° C.

10. Carrier particles for a developer which particles are spherical and have a high surface smoothness and comprise a polyolefin resin having a weight average molecular weight of from about 500 to 20,000 as a binder resin and a magnetic powder having an average particle diameter of not more than about 5 μm dispersed in said binder resin, wherein a molten dispersion comprising said binder resin and said magnetic powder has a viscosity of not more than about 10,000 cp at a temperature of from about 100° to 200° C., and said carrier contains said magnetic powder in an amount of from about 30 to 95% by weight based on the total weight of said binder resin.

* * * * *